US008475546B2

(12) United States Patent
Ten Bosch et al.

(10) Patent No.: US 8,475,546 B2
(45) Date of Patent: Jul. 2, 2013

(54) REACTOR FOR PREPARING SYNGAS

(75) Inventors: Benedict Ignatius Maria Ten Bosch, Amsterdam (NL); Thomas Ebner, Gummersbach (DE); Wouter Koen Harteveld, Amsterdam (NL); Hans Joachim Heinen, Gummerbach (DE); Manfred Heinrich Schmitz-Goeb, Gummersbach (DE)

(73) Assignee: Shell Oil Company, Houston, TX (US)

( * ) Notice: Subject to any disclaimer, the term of this patent is extended or adjusted under 35 U.S.C. 154(b) by 551 days.

(21) Appl. No.: 12/629,776

(22) Filed: Dec. 2, 2009

(65) Prior Publication Data

US 2010/0143216 A1 Jun. 10, 2010

Related U.S. Application Data

(60) Provisional application No. 61/120,994, filed on Dec. 9, 2008.

(30) Foreign Application Priority Data

Dec. 4, 2008 (EP) ..... 08170720

(51) Int. Cl.
*C10J 3/76* (2006.01)
*C10J 3/72* (2006.01)

(52) U.S. Cl.
USPC ..... 48/67; 48/76; 48/61; 48/127.1; 48/127.9; 48/69; 48/128; 48/198.3; 48/203; 48/207; 48/78; 422/605

(58) Field of Classification Search
USPC ..... 48/61, 127.9, 127.1, 76, 67, 69, 128, 48/198.3, 203; 422/605
See application file for complete search history.

(56) References Cited

U.S. PATENT DOCUMENTS

| | | | | |
|---|---|---|---|---|
| 2,572,051 | A | 10/1951 | Perry | 48/203 |
| 3,290,894 | A | 12/1966 | Tsao | 62/216 |
| 2,896,927 | A | 7/1969 | Nagle et al. | 261/35 |

(Continued)

FOREIGN PATENT DOCUMENTS

| | | |
|---|---|---|
| BE | 448968 | 2/1943 |
| CN | 85104027 | 5/1985 |

(Continued)

OTHER PUBLICATIONS

"Shell Gastification Process", Oil and Gas Journal, Sep. 6, 1971, pp. 85-90.

*Primary Examiner* — Kaity V. Handal

(57) ABSTRACT

A reactor vessel includes a dipleg connecting a tubular syngas collection chamber and a quench chamber. The collection chamber connects to the dipleg via a slag tap having a frusto-conical part starting from the lower end of the collection chamber and diverging to an opening connected to an interior of the dipleg. The slag tap has a first tubular part connected to the opening of the frusto-conical part and extending in the direction of the dipleg. A second tubular part connects to the frusto-conical part or to the tubular part and extends toward the dipleg. The second tubular part is spaced away from the dipleg to provide an annular space having a discharge conduit. The discharge conduit has a discharge opening located to direct water along the inner wall of the dipleg. At least half of the vertical length of the first tubular part extends below the discharge opening.

6 Claims, 2 Drawing Sheets

U.S. PATENT DOCUMENTS

| | | | | | |
|---|---|---|---|---|---|
| 3,537,977 | A | | 11/1970 | Smith | 208/89 |
| 4,165,274 | A | | 8/1979 | Kwant | 208/93 |
| 4,202,672 | A | | 5/1980 | Schuurman | 48/77 |
| 4,218,423 | A | | 8/1980 | Robin et al. | 422/207 |
| 4,272,255 | A | | 6/1981 | Coates | 48/63 |
| 4,328,007 | A | | 5/1982 | Rafael | 48/73 |
| 4,343,626 | A | | 8/1982 | Peise et al. | 48/67 |
| 4,437,864 | A | * | 3/1984 | Gorris et al. | 48/62 R |
| 4,442,800 | A | | 4/1984 | Seifert et al. | 122/379 |
| 4,444,726 | A | | 4/1984 | Crotty, Jr. et al. | 422/207 |
| 4,466,808 | A | * | 8/1984 | Koog | 48/197 R |
| 4,473,033 | A | | 9/1984 | Strohmeyer, Jr. | 122/4 D |
| 4,474,584 | A | | 10/1984 | Koog | 48/197 |
| 4,523,529 | A | | 6/1985 | Poll | 110/263 |
| 4,525,175 | A | | 6/1985 | Stellaccio | 48/86 R |
| 4,605,423 | A | * | 8/1986 | Koog | 48/69 |
| 4,624,683 | A | | 11/1986 | Dach | 48/69 |
| 4,666,463 | A | | 5/1987 | Stellaccio | 48/197 R |
| 4,705,542 | A | | 11/1987 | Gilmer | 55/93 |
| 4,731,097 | A | | 3/1988 | Köhnen et al. | 48/76 |
| 4,778,483 | A | * | 10/1988 | Martin et al. | 48/69 |
| 4,801,306 | A | | 1/1989 | Denbleyker | 48/69 |
| 4,801,307 | A | | 1/1989 | Muenger et al. | 48/69 |
| 4,808,197 | A | | 2/1989 | Ayers | 48/69 |
| 4,809,625 | A | | 3/1989 | Garcia-Mallol et al. | 110/347 |
| 4,818,252 | A | | 4/1989 | Köhnen et al. | 48/67 |
| 4,818,253 | A | * | 4/1989 | Kohnen et al. | 48/67 |
| 4,818,423 | A | | 4/1989 | Steinbach et al. | 252/49.6 |
| 4,828,578 | A | * | 5/1989 | Den Bleyker | 48/69 |
| 4,828,580 | A | | 5/1989 | Dach | 48/69 |
| 4,852,997 | A | | 8/1989 | Segerstrom et al. | 48/210 |
| 4,880,438 | A | | 11/1989 | Den Bleyker | 48/69 |
| 4,992,081 | A | | 2/1991 | Den Bleyker | 48/69 |
| 5,069,755 | A | | 12/1991 | Durr et al. | 202/169 |
| 5,133,941 | A | | 7/1992 | Hays et al. | 422/140 |
| 5,248,316 | A | | 9/1993 | Peise et al. | 48/76 |
| 5,271,243 | A | | 12/1993 | Jelich | 62/304 |
| 5,293,843 | A | | 3/1994 | Provol et al. | 122/4 D |
| H1325 | H | | 7/1994 | Doering et al. | |
| 5,513,599 | A | | 5/1996 | Nagato et al. | 122/4 |
| 5,553,571 | A | | 9/1996 | Campbell et al. | 122/379 |
| 5,570,645 | A | | 11/1996 | Garcia-Mallol | 110/245 |
| 5,958,365 | A | | 9/1999 | Liu | 423/655 |
| 5,968,212 | A | | 10/1999 | Peise et al. | 48/101 |
| 5,976,203 | A | * | 11/1999 | Deeke et al. | 48/62 R |
| 6,283,048 | B1 | | 9/2001 | Fujinami et al. | 110/346 |
| 6,311,629 | B1 | | 11/2001 | Marschner et al. | 110/341 |
| 6,312,482 | B1 | | 11/2001 | James et al. | 48/73 |
| 6,562,102 | B1 | | 5/2003 | Kepplinger et al. | 75/445 |
| 6,702,936 | B2 | | 3/2004 | Rettger et al. | 208/86 |
| 7,037,473 | B1 | | 5/2006 | Donner et al. | 422/242 |
| 7,587,995 | B2 | * | 9/2009 | Kraft et al. | 122/7 R |
| 8,048,178 | B2 | * | 11/2011 | Smit et al. | 48/197 R |
| 8,052,864 | B2 | * | 11/2011 | Eilers et al. | 208/86 |
| 2001/0020346 | A1 | | 9/2001 | Schingnitz et al. | 48/127.9 |
| 2006/0260192 | A1 | | 11/2006 | Barot | 48/197 R |
| 2007/0011945 | A1 | | 1/2007 | Grootveld et al. | 48/197 R |
| 2007/0062117 | A1 | | 3/2007 | Schingnitz et al. | 48/210 |
| 2007/0079554 | A1 | * | 4/2007 | Schingnitz et al. | 48/210 |
| 2007/0272129 | A1 | | 11/2007 | Schilder | 110/171 |
| 2008/0005966 | A1 | | 1/2008 | Fischer et al. | 48/210 |
| 2008/0141588 | A1 | | 6/2008 | Kirchhubel et al. | 48/77 |
| 2008/0172941 | A1 | * | 7/2008 | Jancker et al. | 48/73 |
| 2008/0222955 | A1 | * | 9/2008 | Jancker et al. | 48/67 |
| 2010/0140817 | A1 | | 6/2010 | Harteveld et al. | 261/112.1 |
| 2010/0143216 | A1 | | 6/2010 | Ten Bosch et al. | 422/207 |

FOREIGN PATENT DOCUMENTS

| | | |
|---|---|---|
| CN | 86103455 | 5/1986 |
| CN | 1209447 | 3/1999 |
| DE | 2342079 | 11/1975 |
| DE | 2425962 | 8/1978 |
| DE | 2935754 | 6/1980 |
| DE | 3009850 | 4/1983 |
| DE | 19643258 | 4/1998 |
| DE | 19829385 | 10/1999 |
| DE | 19952754 | 5/2001 |
| DE | 19957696 | 5/2001 |
| DE | 200317461 | 8/2004 |
| EP | 127878 | 12/1984 |
| EP | 160424 | 11/1985 |
| EP | 129737 | 1/1986 |
| EP | 0168128 | 1/1986 |
| EP | 291111 | 11/1988 |
| EP | 0374323 | 6/1990 |
| EP | 0024281 | 11/1992 |
| EP | 545281 | 6/1993 |
| EP | 683218 | 11/1995 |
| EP | 759886 | 7/1998 |
| EP | 1373441 | 6/1999 |
| GB | 1413996 | 11/1975 |
| SU | 839442 | 5/1974 |
| WO | WO9532148 | 11/1995 |
| WO | WO9603345 | 2/1996 |
| WO | WO9639354 | 12/1996 |
| WO | WO9722547 | 6/1997 |
| WO | WO9925648 | 5/1999 |
| WO | WO2007125046 | 11/2007 |
| WO | WO2008065184 | 6/2008 |
| WO | WO2008110592 | 9/2008 |
| WO | WO2008113766 | 9/2008 |

* cited by examiner

REACTOR FOR PREPARING SYNGAS

This application claims the benefit of European Application No. 08170720.0 filed Dec. 4, 2008 and U.S. Provisional Application No. 61/120,994 filed Dec. 9, 2008, both of which are incorporated herein by reference.

BACKGROUND OF THE INVENTION

The invention is directed to a reactor for preparing syngas comprising a syngas collection chamber and a quench chamber. The syngas outlet of the syngas collection chamber is fluidly connected with the quench chamber via a tubular dipleg.

Such a reactor is described in U.S. Pat. No. 4,828,578. This publication describes a gasification reactor having a reaction chamber provided with a burner wherein a fuel and oxidant are partially oxidized using oxygen gas to produce a hot gaseous product. The hot gases are passed via a constricted throat to be cooled in a liquid bath located below the reaction chamber. A dipleg guides the hot gases into the bath.

When such a reactor is used to gasify ash containing feedstocks slag may block the constricted throat. To avoid such blockage one will have to continuously operate the reactor at a more elevated gasification temperature than the temperature at which one would ideally operate from an efficiency point of view.

SUMMARY OF THE INVENTION

The present invention aims to provide an improved reactor, which can be operated closer to the optimal gasification temperature while minimizing the risk for blockage by slag.

This is achieved by a reactor vessel for preparing a syngas comprising a tubular syngas collection chamber, a quench chamber and a dipleg connecting the syngas collection chamber with the quench chamber, wherein the syngas collection chamber is connected to the dipleg via a slag tap, comprising a frusto-conical part starting from the lower end of the tubular wall of the syngas collection chamber and diverging to an opening fluidly connected to the interior of the dipleg, wherein the diameter of said opening is smaller than the diameter of the dipleg, wherein the frusto-conical part comprises one or more conduits having an inlet for cooling medium and an outlet for used cooling medium, wherein the slag tap also comprises a first tubular part connected to the opening of the frusto-conical part and extending in the direction of the dipleg, wherein a second tubular part is connected to the frusto-conical part or to the tubular part and extending in the direction of the dipleg and having a diameter smaller than the diameter of the dipleg and larger than the diameter of the opening of the frusto-conical part and wherein the second tubular part is spaced away from the dipleg to provide an annular space and wherein in said annular space a discharge conduit for liquid water is present having a liquid water discharge opening located such to direct the liquid water along the inner wall of the dipleg, and wherein at least half of the vertical length of the first tubular part extends below the liquid water discharge opening.

Applicants found that by providing the claimed frusto-conical part it is possible to predict blockage by slag by measuring the temperature of the used cooling water or steam make in the conduits of the frusto-conical part. Typically a decrease in temperature of the used cooling water or a decrease in steam make is indicative for a growing layer of slag. Thus one can operate closer to the optimal gasification temperature, while simultaneously being able to monitor the slag layer thickness.

BRIEF DESCRIPTION OF THE DRAWINGS

The invention and its preferred embodiments will be further described by means of the following figures.

DETAILED DESCRIPTION

Syngas has the meaning of a mixture comprising carbon monoxide and hydrogen. The syngas is preferably prepared by gasification of an ash comprising carbonaceous feedstock, such as for example coal, petroleum coke, biomass and deasphalted tar sands residues. The coal may be lignite, bituminous coal, sub-bituminous coal, anthracite coal and brown coal. The syngas as present in the syngas collection chamber may have a temperature ranging from 600 to 1500° C. and have a pressure of between 2 and 10 MPa. The syngas is preferably cooled, in the vessel according the present invention, to below a temperature, which is 50° C. higher than the saturation temperature of the gas composition. More preferably the syngas is cooled to below a temperature, which is 20° C. higher than the saturation temperature of the gas composition.

Figure 1:
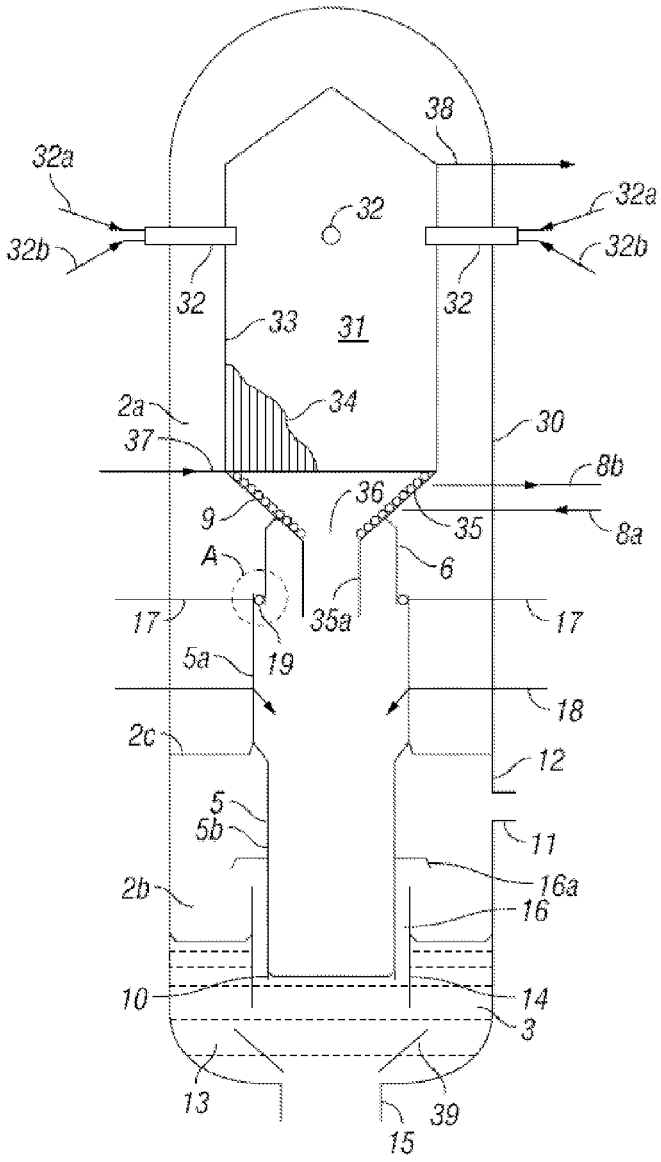
FIG. 1 is a reactor according to the invention.

FIG. 1 shows a reactor vessel 30 comprising a tubular syngas collection chamber 31, a quench chamber 3. Dipleg 5 connects the syngas collection chamber 31 with the quench chamber 3. The syngas collection chamber 31 is connected to the dipleg 5 via a slag tap 9, comprising a frusto-conical part 35 starting from the lower end of the tubular wall of the syngas collection chamber 31 and diverging to an opening 36. The opening 36 fluidly connects the interior of the syngas collection chamber 31 to the interior of the dipleg 5. The diameter of opening 36 is smaller than the diameter of the dipleg 5. If the dipleg 5 has varying diameters the largest diameter is meant. The frusto-conical part 35 comprises one or more conduits having in inlet 8*a* for a cooling medium and an outlet 8*b* for used cooling medium.

The tubular syngas collection chamber 31 is provided with 4 horizontally firing burners 32. The number of burners may suitably be from 1 to 8 burners. To said burners the carbonaceous feedstock and an oxygen containing gas are provided via conduits 32*a* and 32*b*. The wall 33 of the syngas collection chamber 31 is preferably an arrangement of interconnected parallel arranged tubes 34 resulting in a substantially gas-tight tubular wall 33. Only part of the tubes are drawn in FIG. 1. The tubes 34 run from a lower arranged cooling water distributor 37 to a higher arranged header 38. The burners 32 are arranged in FIG. 1 as described in for example WO-A-2008110592, which publication is incorporated by reference. The burners or burner may alternatively be directed downwardly as for example described in WO-A-2008065184 or in US-A-2007079554. In use a layer of liquid slag will be present on the interior of wall 33. This slag will flow downwards, via slag tap 9 and dipleg 5 and will be discharged from the reactor via outlet 15.

In use the reactor vessel 30 is vertically oriented as shown in the FIG. 1. References to vertical, horizontal, top, bottom, lower and upper relate to this orientation. Said terms are used to help better understand the invention but are by no means intended to limit the scope of the claims to a vessel having said orientation.

The syngas collection chamber 31 and the dipleg 5 have a smaller diameter than the reactor vessel 30 resulting in an upper annular space 2*a* between said chamber 31 and the wall of reactor vessel 30 and a lower annular space 2*b* between the dipleg 5 and the wall of reactor vessel 30. Annular space 2*a* and 2*b* are preferably gas tight separated by sealing 2*c* to avoid ingress of ash particles from space 2*b* into space 2*a*.

Preferably the slag tap 9 also comprises a tubular part 35*a* connected to the opening 36 of the frusto-conical part 35 and extending in the direction of the dipleg 5. This part 35*a* is preferred because it will guide slag downwards into the dipleg 5 and into the water bath 13 where the slag solidifies. In water bath 13 the solidified slag particles are guided by means of an inverted frusto-conical part 39 to outlet 15.

The presence of part 35*a* is advantageous because one then avoids slag particles to foul a water discharge conduit 19' which will be described in more detail below. If such a tubular part 35*a* would not be present small slag particles may be carried to a circular opening 19 by recirculating gas. By having a tubular part of sufficient length such recirculation in the region of opening 19 is avoided. Preferably the length of 35*a* is such that the lower end terminates at or below the opening 19. Even more preferably the lower end terminates below the opening 19, wherein at least half of the vertical length of the tubular part 35*a* extends below opening 19.

Preferably at the end of the dipleg 5 which is nearest to the syngas collection chamber 31 means for introducing water are present, more preferably such means is a circular opening 19 for introducing water, fluidly connected to a water supply line 17. Such means preferably have an outflow opening for liquid water directed such that, in use, a film of water is achieved along the inner wall of the dipleg 5.

FIG. 1 also shows a preferred next tubular part 6 as connected to the frusto-conical part 35 or to the optional tubular part 35*a* and extending in the direction of the dipleg 5. The next tubular part 6 has a diameter smaller than the diameter of the dipleg 5 at its upper end. This diameter of part 6 is larger than the diameter of the opening 36 of the frusto-conical part 35. The next tubular part 6 is preferably spaced away from the dipleg 5 to provide a circular opening 19 for introducing water.

Preferably the frusto-conical part 35 is directly connected to a cooling supply conduit and directly connected to a cooling discharge conduit. By having a cooling system for the frusto-conical part 35 which is separate from for example the optional cooling system for the wall of the syngas collection chamber 31 it is even more easy to measure the local heat transfer and predict if slag tap blockage may occur.

Preferably the tubular part 35*a* comprises one or more conduits having in inlet for cooling medium and an outlet for used cooling medium. More preferably the tubular part 35*a* is directly connected to a cooling supply conduit and directly connected to a cooling discharge conduit. By having a cooling system for the tubular part 35*a* which is separate from for example the cooling system for the frusto-conical part 35 or the optional cooling system for the wall of the syngas collection chamber 31 it is even more easy to measure the local heat transfer and predict if slag tap blockage may occur.

Figure 1A:
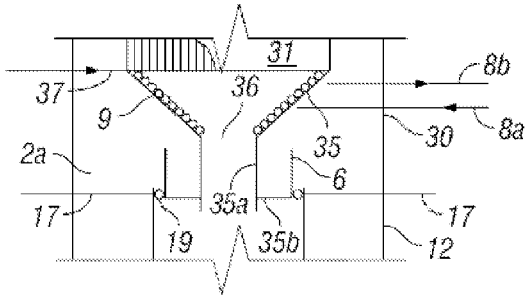
FIG. 1*a* shows an alternative design for a section of the reactor of FIG. 1.

In FIG. 1*a* a preferred embodiment for tubular part 35*a* is shown, wherein the lower end of tubular part 35*a* is fixed by a plane 35*b* extending to the lower end of the next tubular part 6. This design is advantageous because less stagnant zones are present where solid ash particles can accumulate.

The frusto-conical part 35 and the optional tubular parts 35*a* and 35*b* comprise one or more conduits, through which in use boiling cooling water or sub-cooled cooling water, flows. The design of the conduits of parts 35, 35*a* and 35*b* may vary and may be for example spirally formed, parallel formed, comprising multiple U-turns or combinations.

Preferably the temperature of the used cooling water or steam make of these parts 35 and 35*a* are measured to predict the thickness of the local slag layer on these parts. This is especially advantageous if the gasification process is run at temperatures, which would be beneficial for creating a sufficiently thick slag layer for a specific feedstock, such as low ash containing feedstocks like certain biomass feeds and tar sand residues. Or in situations where a coal feedstock comprises components that have a high melting point. The danger of such an operation is that accumulating slag may block opening 36. By measuring the temperature of the cooling water or the steam make one can predict when such a slag accumulation occurs and adjust the process conditions to avoid such a blockage.

The invention is thus also directed to avoid slag blockage in a reactor according to the present invention, by (i) measuring the temperature of the cooling water as it is discharged from the conduit(s) of the frusto-conical part or from the tubular part or by measuring the steam make in the conduit(s) of the frusto-conical part or from the tubular part, (ii) predict if a slag blockage could occur based on these measurements and (iii) adjust the process conditions if necessary to avoid such a blockage.

Typically a decrease in temperature of the used cooling water or a decrease in steam make are indicative of a growing layer of slag. The process is typically adjusted by increasing the gasification temperature in the reaction chamber such that the slag will become more fluid and consequently a reduction in thickness of the slag layer on parts 35 and 35*a* will result. The reactor is preferably provided with means to measure the above cooling water temperature or steam make, means to predict if slag blockage may occur based on said measurements and control means to adjust the gasification conditions to avoid slag blockage. The supply and discharge conduits for this cooling water are not shown in FIG. 1.

The dipleg 5 is open to the interior of the reactor vessel 30 at its lower end 10. This lower end 10 is located away from the syngas collection chamber 31 and in fluid communication with a gas outlet 11 as present in the vessel wall 12. The dipleg is partly submerged in a water bath 13. Around the lower end of the dipleg 5 a draft tube 14 is present to direct the syngas upwardly in the annular space 16 formed between draft tube 14 and dipleg 5. At the upper discharge end of the annular space 16 deflector plate 16*a* is present to provide a rough separation between entrained water droplets and the quenched syngas. Deflector plate 16*a* preferably extends from the outer wall of the dipleg 5.

The lower part 5*b* of the dipleg 5 preferably has a smaller diameter than the upper part 5*a* as shown in FIG. 1. This is advantageous because the layer of water in the lower end will increase and because the annular area for the water bath 13 will increase. This is advantageous because it enables one to use a more optimized, smaller, diameter for reactor vessel 30. The ratio of the diameter of the upper part to the diameter of the lower part is preferably between 1.25:1 and 2:1.

FIG. 1 also shows preferred water spray nozzles 18 located in the dipleg 5 to spray droplets of water into the syngas as it flows downwardly through the dipleg 5. The nozzles 18 are preferably sufficiently spaced away in a vertical direction from the opening 19 to ensure that any non-evaporated water droplets as sprayed into the flow of syngas will contact a wetted wall of the dipleg 5. Applicants have found that if such droplets would hit a non-wetted wall ash may deposit, thereby forming a very difficult to remove layer of fouling. In an embodiment with a dipleg 5 having a smaller diameter lower part 5*b* as discussed above it is preferred that the nozzles 18 are positioned in the larger diameter part 5*a*. More residence time is achieved by the larger diameter resulting in that the water as injected has sufficient time to evaporate.

Figure 2:
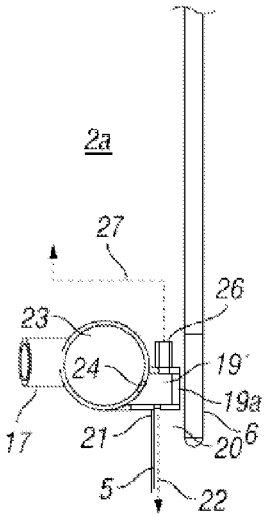
FIG. 2 is a side-view of a preferred embodiment for detail A of FIG. 1.

FIG. 2 shows detail A of FIG. 1 for a preferred embodiment of opening 19. FIG. 2 shows that the next tubular part 6 terminates at a point within the space enclosed by the dipleg 5 such that an annular space 20 is formed between the next tubular part 6 and the dipleg 5. In the annular space 20 a discharge conduit 19' for a liquid water is present having a discharge opening 21 located such to direct the liquid water 22 along the inner wall of the dipleg 5. Conduit 19' and tubular part 6 are preferably not fixed to each other and more preferably horizontally spaced away from each other. This is advantageous because this allows both parts to move relative to each other. This avoids, when the vessel is used, thermal stress as both parts will typically have a different thermal expansion. The gap 19*a* as formed between conduit 19' and part 6 will allow gas to flow from the syngas collection chamber 31 to the space 2*a* between the wall of the chamber 31 and the wall of vessel 1. This is advantageous because it results in pressure equalization between said two spaces. The discharge conduit 19' preferably runs in a closed circle along the periphery of the tubular part 6 and has a slit like opening 21 as the discharge opening located at the point where the discharge conduit 19' and the inner wall of the dipleg 5 meet. In use, liquid water 22 will then be discharged along the entire inner circumference of the wall of the dipleg 5. As shown conduit 19' does not have discharge openings to direct water into the flow of syngas, which is discharged via syngas outlet 11.

FIG. 2 also shows that the discharge conduit 19' is suitably fluidly connected to a circular supply conduit 23. Said supply conduit 23 runs along the periphery of the discharge conduit 19'. Both conduits 19' and 23 are fluidly connected by numerous openings 24 along said periphery. Alternatively, not shown in FIGS. 2 and 3, is an embodiment wherein the discharge conduit 19' is directly fluidly connected to one or more supply lines 17 for liquid water under an angle with the radius of the closed circle, such that in use a flow of liquid water results in the supply conduit.

Preferably the discharge conduit 19' or conduit 23 are connected to a vent. This vent is intended to remove gas, which may accumulate in said conduits. The ventline is preferably routed internally in the vessel 1 through the sealing 2*c* to be fluidly connected to annular space 2*b*. The lower pressure in said space 2*b* forms the driving force for the vent. The size of the vent line, for example by sizing an orifice in said ventline, is chosen such that a minimum required flow is allowed, possibly also carrying a small amount of water together with the vented gas into the annular space 2*b*. Preferably conduit 19' is provided with a vent as shown in FIG. 2, wherein the discharge conduit 19' has an extending part 26 located away from the discharge opening 21, which extending part 26 is fluidly connected to a vent conduit 27.

Figure 3:
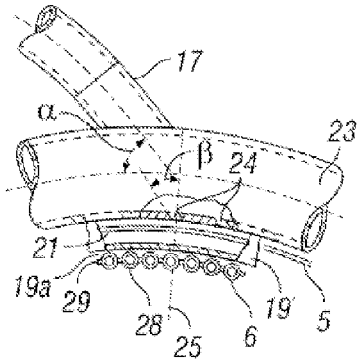
FIG. 3 is a top view of detail A of FIG. 2.

The circular supply conduit 23 of FIG. 3 is suitably fluidly connected to one or more supply lines 17 for liquid water under an angle $\alpha$, such that in use a flow of liquid water results in the supply conduit 23. Angle $\alpha$ is preferably between 0 and 45°, more preferably between 0 and 15°. The number of supply lines 17 may be at least 2. the maximum number will depend on the dimensions of for example the conduit 23. The separate supply lines 17 may be combined upstream and within the vessel 1 to limit the number of openings in the wall of vessel 1. The discharge end of supply line 17 is preferably provided with a nozzle to increase the velocity of the liquid water as it enters the supply conduit 23. This will increase the speed and turbulence of the water as it flows in conduit 23, thereby avoiding solids to accumulate and form deposits. The nozzle itself may be an easy to replace part having a smaller outflow diameter than the diameter of the supply line 17.

The openings 24 preferably have an orientation under an angle $\beta$ with the radius 25 of the closed circle, such that in use a flow of liquid water results in the discharge conduit 19' having the same direction has the flow in the supply conduit 23. Angle $\beta$ is preferably between 45 and 90°.

FIG. 3 also shows next tubular part 6 as an arrangement of interconnected parallel arranged tubes 28 resulting in a substantially gas-tight tubular wall 29.

What is claimed is:

1. A reactor vessel for preparing a syngas comprising a tubular syngas collection chamber, a quench chamber and a dipleg connecting the syngas collection chamber with the quench chamber, wherein the syngas collection chamber is connected to the dipleg via a slag tap, comprising of a frusto-conical part starting from the lower end of a tubular wall of the syngas collection chamber and converging to an opening fluidly connected to the interior of the dipleg, wherein the diameter of said opening is smaller than the diameter of the dipleg, and wherein the frusto-conical part comprises one or more conduits having in inlet for cooling medium and an outlet for used cooling medium, wherein the slag tap also comprises a first tubular part connected to the opening of the frusto-conical part and extending in the direction of the dipleg, wherein a second tubular part is connected to the frusto-conical part or to the tubular part and extending in the direction of the dipleg and having a diameter smaller than the diameter of the dipleg and larger than the diameter of the opening of the frusto-conical part and wherein the second tubular part is spaced away from the dipleg to provide an annular space and wherein in said annular space a discharge conduit for liquid water is present having a liquid water discharge opening located such to direct the liquid water along the inner wall of the dipleg, and wherein at least half of the vertical length of the first tubular part extends below the liquid water discharge opening.

2. A reactor according to claim 1, wherein the frusto-conical part is directly connected to a cooling supply conduit and directly connected to a cooling discharge conduit.

3. A reactor according to claim 1, wherein the first tubular part comprises one or more conduits having an inlet for cooling medium and an outlet for used cooling medium.

4. A reactor according to claim 1, wherein lower end of the first tubular part is fixed by a plane extending to the lower end of the second tubular part.

5. A reactor according to claim 1, wherein one or more water spray nozzles are located in the dipleg which, in use, spray droplets of water into a stream of syngas flowing downwardly through the dipleg.

6. A reactor according to claim 1, wherein the syngas collection chamber comprises an arrangement of interconnected parallel tubes resulting in a gas-tight tubular wall running from a distributor to a header, said distributor provided with a cooling water supply conduit and said header provided with a steam discharge conduit.

* * * * *